US005803445A

United States Patent [19]

Eberle

[11] Patent Number: 5,803,445

[45] Date of Patent: Sep. 8, 1998

[54] ARRANGEMENT FOR DELIVERING PRINTED PRODUCTS TO A REMOVAL CONVEYOR

[75] Inventor: Jürg Eberle, Hinwil, Switzerland

[73] Assignee: Ferag AG, Hinwil, Switzerland

[21] Appl. No.: 688,399

[22] Filed: Jul. 30, 1996

[51] Int. Cl.[6] ..... B65H 5/22

[52] U.S. Cl. ..... 271/3.11; 271/95; 271/196; 271/276; 271/277; 271/3.08

[58] Field of Search ..... 271/3.01, 3.02, 271/3.08, 3.11, 169, 194, 196, 204, 276, 277, 95, 91

[56] References Cited

U.S. PATENT DOCUMENTS

| | | | |
|---|---|---|---|
| 3,224,558 | 12/1965 | Carlen | 198/461.1 |
| 3,735,977 | 5/1973 | Reist | 271/75 |
| 4,071,234 | 1/1978 | Schick | 271/11 |
| 4,127,262 | 11/1978 | Eberle et al. | 271/12 |
| 4,279,412 | 7/1981 | Glatz | 271/108 |
| 4,320,894 | 3/1982 | Reist et al. | 271/277 |
| 4,350,330 | 9/1982 | Brown | 271/12 |
| 5,042,792 | 8/1991 | Honegger et al. | 271/188 |
| 5,377,967 | 1/1995 | Eberle | 271/11 |
| 5,398,920 | 3/1995 | Leu | 271/3.1 |
| 5,542,656 | 8/1996 | Stauber | 271/11 |
| 5,664,770 | 9/1997 | Keller | 271/3.11 |
| 5,711,521 | 1/1998 | Reist | 271/225 |

FOREIGN PATENT DOCUMENTS

| | | |
|---|---|---|
| 240266 | 5/1965 | Austria . |
| 401933 | 9/1924 | Germany . |

*Primary Examiner*—William E. Terrell
*Assistant Examiner*—Wonki Park
*Attorney, Agent, or Firm*—Brinks Hofer Gilson & Lione

[57] ABSTRACT

An arrangement has a rotor with rotor arms that are arranged in a drum-like manner around an axis of rotation and project on one side from a carrying element that is driven in rotation. The arrangement also has a sucker arrangement that includes a carrying arm which is driven by a drive. At a free end of the carrying arm there is arranged an extension arm with a suction head. The movement path of the suction head runs in the interior of the rotor, with the exception of an approximately V-shaped section of the movement path projecting in a radial direction outside the rotor. When the extension arm runs through this section, it passes through a cutout of the rotor in order to grip a corner region of a printed product and move the printed product into the interior of the rotor. A rotor arm then engages beneath the printed product and lifts it further in order to deliver it to a range of action of a removal conveyor.

20 Claims, 4 Drawing Sheets

ARRANGEMENT FOR DELIVERING PRINTED PRODUCTS TO A REMOVAL CONVEYOR

BACKGROUND OF THE INVENTION

The present invention relates to an arrangement for delivering printed products into a range of action of a removal conveyor, and to an apparatus for processing printed products.

The earlier CH Patent Application No. 02 183/95-9 discloses an apparatus for processing printed products having a feed conveyor that conveys the printed products in imbricated formation against a stop. The printed products are pushed up by the stop to form an intermediate stack. The uppermost printed product is gripped and lifted by a sucker arrangement adjacent to the center of a border region extending along the folded edge. A solid wheel-like rotor is driven in rotation synchronously with the sucker arrangement. The rotor has a plurality of cutouts that are distributed on its circumference and into which the folded edges of the printed products are introduced individually by the sucker arrangement. As a result of the rotation of the rotor, the printed product, which is then released by the sucker arrangement, is directed into a conveying nip formed by the rotor and a pressing-on belt interacting with the rotor. The printed product is then moved into the range of action of a removal conveyor and a new imbricated formation is formed in the process. In this case, the rotor acts centrally on the printed products.

A further apparatus for processing printed products, having an arrangement for delivering the printed products into the range of action of a removal conveyor, is disclosed in the earlier CH Patent Application No. 02 206/95-6. The arrangement has a rotor with rotor arms that are arranged in a drum-like manner around the axis of rotation of the rotor. The rotor arms extend in the direction of the axis of rotation, project on one side from a driven solid wheel-like carrying element, and are separated from one another by cutouts that are open on a side directed away from the carrying element. The printed products arriving in imbricated formation are conveyed against a stop by a feed conveyor. A rotor arm engages, from the edge located opposite the stop, beneath a corner region of the printed product butting against the stop. The rotor arm then lifts the printed product, in its border region, from the respectively following printed product, and moves it into a conveying nip formed by the rotor and a pressure-exerting belt interacting with the rotor. With the formation of a new imbricated formation, the printed products gripped by the conveying nip are drawn away from the stop and moved into the range of action of a removal conveyor. This arrangement does not require a sucker arrangement. Its operating speed, however, is likely to be limited since, in order to avoid damage to the printed products, the rotor arms may not be inserted at any random speed between the printed product butting against the stop and the following printed product.

U.S. Pat. No. 5,042,792 and the corresponding EP-A-0 368 009 also disclose an apparatus for processing printed products that arrive in an imbricated formation in which two printed products rest congruently one upon the other. The printed products are conveyed against a stop by a feed conveyor. The respectively uppermost printed product butting against the stop is gripped in the central region by a sucker arrangement, and is made to curve. A rotor that is driven in rotation and is designed in a star wheel-like manner engages, via a driver element, beneath the lifted printed product. As a result, the printed product, which is then released by the sucker arrangement, is curved to a greater extent. The rotor then takes the printed product along in order to move it into the range of action of a removal conveyor. Both the sucker arrangement and the rotor act on the printed products in the center of a border region that adjoins the leading edge. The drive and the mount of the rotor are arranged, in relation to the center, on one side and the drive of the sucker arrangement is arranged on the other side.

An object of the present invention is to provide an arrangement for delivering printed products into the range of action of a removal conveyor that has a particularly compact construction and is suitable for high processing speeds. A further object is to provide an apparatus that takes up a small amount of space, is intended for processing printed products, has an arrangement of this type, and is likewise suitable for high processing speeds.

SUMMARY OF THE INVENTION

The present invention provides an arrangement for delivering printed products into a range of action of a removal conveyor comprising a carrying element driven in a direction of rotation, a rotor, and a sucker arrangement. The rotor has rotor arms, an interior, and an axis of rotation. The rotor arms are arranged in a drum-like manner around the axis of rotation of the rotor. The rotor arms also extend in the direction of the axis of rotation of the rotor and project outwardly from a side of the carrying element. In addition, the rotor arms are separated from one another by cutouts having an open side opposite the carrying element.

The sucker arrangement has a drive that is synchronized with the rotor and is located on a side of the carrying element opposite the rotor. The sucker arrangement also has a carrying arm that is at least approximately parallel to the axis of rotation of the rotor. The carrying arm has an end connected to the drive and an extension arm connected to an end of the carrying arm opposite the drive. The extension arm runs transversely with respect to the axis of rotation and has a suction head attached to an end of the extension arm opposite the carrying arm. The suction head is periodically connected to a negative-pressure source and is driven in circulation along a closed movement path by the drive. The movement path runs in the interior of the rotor has an approximately V-shaped section projecting in a radial direction through the cutouts and outside of the rotor. The approximately V-shaped section has a tip.

In this arrangement of the present invention, the suction head grips a region adjoining a corner of a printed product at a receiving location provided at the tip of the approximately V-shaped section of the movement path. The suction head holds the printed product until it reaches a discharge location located in the interior of the rotor. The printed product then passes through the cutout into the interior of the rotor at the discharge location.

Next, the rotor arm directly following the cutout in the direction of the rotation butts against the printed product on a side located opposite the suction head. The rotor then supports the printed product released by the suction head and forces it into a range of action of a removal conveyor.

The present invention also provides an apparatus for processing printed products comprising a feed conveyor with a conveying region for conveying printed products in a feed direction against a stop, and a removal conveyor having a range of action arranged above the feed conveyor. In addition, the apparatus of the present invention further comprises an arrangement for delivering printed products into the range of action of the removal conveyor. The arrangement has a carrying element arranged laterally outside the conveying region of the feed conveyor, and a rotor with rotor arms arranged above the conveying region of the feed conveyor.

DETAILED DESCRIPTION

Figure 1:
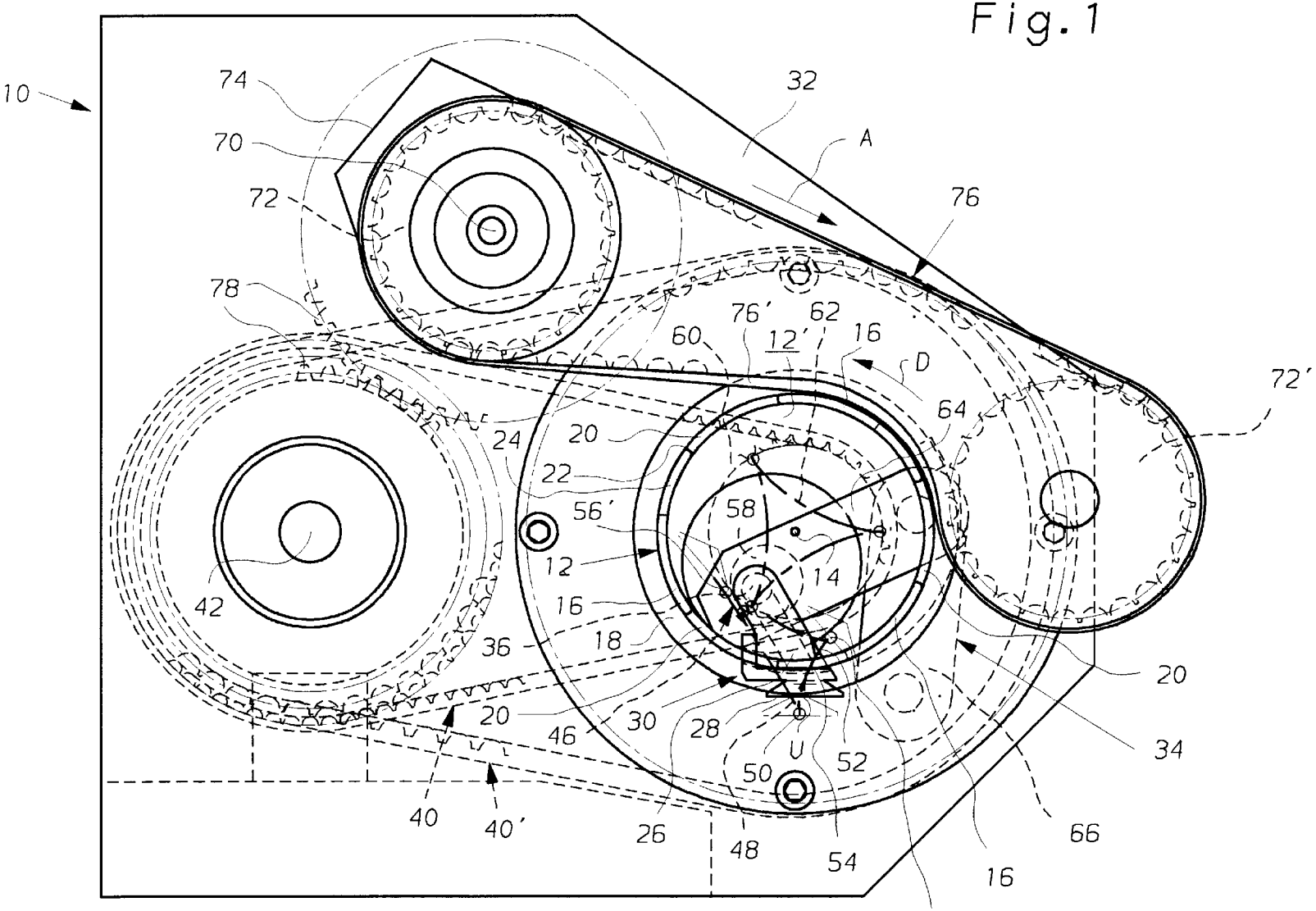
FIG. 1 shows, in elevation, an arrangement of the present invention for delivering printed products into a range of action of a removal conveyor.
Figure 2:
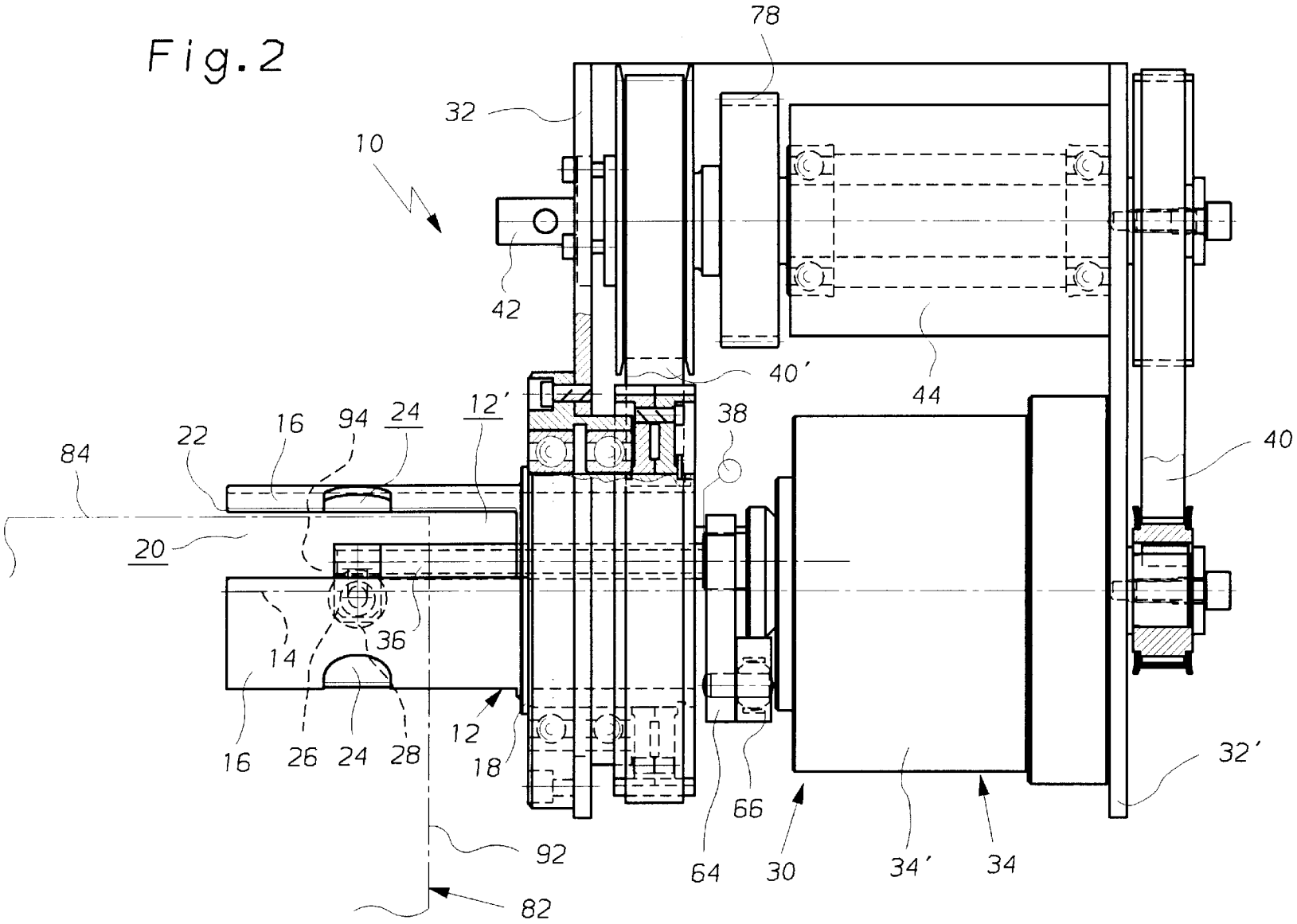
FIG. 2 shows a plan view, partly in section, of the arrangement of FIG. 1, but without a pressure-exerting belt, the belt not necessarily having to be provided.

An arrangement 10 of a preferred embodiment of the present invention is designed as a compact unit as shown in FIGS. 1–2. The arrangement 10 has a rotor 12 with rotor arms 16 that are arranged in a drum-like manner around an axis of rotation 14 of the rotor. The rotor arms 16 extend in the direction of the axis of rotation 14 and project on one side from an annular carrying element 18 driven in the direction of rotation D. In addition, the rotor arms 16 (of which there are three in the example shown) are distributed uniformly in the circumferential direction and are separated from one another by cutouts 20 that are open on the side directed away from the carrying element 18. The rotor arms 16 take the form of a region located between surface lines of a circular hollow cylinder. Approximately in the center, with respect to the direction of the axis of rotation 14, the rotor arms 16 have an incision 24 that extends from the trailing edge 22, with respect to the direction of rotation D. The incision 24 widens the cutout 20 in this region in order to form a larger through-passage for an extension arm 26 and a suction head 28. The suction head 28 is arranged at the free end of the extension arm and belongs to a sucker arrangement 30.

The carrying element 18 is mounted in a freely rotatable manner on a first bearing plate 32 that is fixedly connected to a second bearing plate 32'. A drive 34 of the sucker arrangement 30 is fastened on the second bearing plate 32' which is arranged on a side of the first bearing plate 32 that is directed away from the rotor arms 16. A tubular carrying arm 36, which is arranged parallel to the axis of rotation 14, projects from the drive 34 into the interior of the rotor 12, and passes through the carrying element 18 in the process. The extension arm 26 is fastened at this free end of the carrying arm 36. The suction head 28 is flow-connected by a flow duct in the extension arm 26 to the carrying arm 36. On the drive side, the carrying arm 36 may be periodically connected to a negative-pressure source 38.

Both the drive 34 and the carrying element 18 are each connected by a toothed-belt drive 40, 40', respectively, to an output shaft 42 of a motor 44. As a result, the rotation of the rotor 20 is synchronized with the drive 34.

The drive 34 moves the suction head 28 in circulation, in the arrow direction U, along a movement path that is indicated by chain-dotted lines in FIG. 1 and designated by reference numeral 46. The movement path 46 runs in the interior 12' of the rotor 12, with the exception of an approximately V-shaped section 48. In section 48, the movement path 46 intersects the rotary path of the rotor arms 16 and projects outward in the radial direction beyond the rotor 12. When the extension arm 26 runs through the section 48, it passes through a cutout 20 of the rotor 12. The tip or the turning point in section 48 of the movement path 46 defines a receiving location 50, at which the suction head 28 is connected to the negative-pressure source 38. As seen in the direction of circulation U, the receiving location 50 is followed by a discharge location 52 that is arranged in the interior 12' of the rotor 12. At the discharge location 52, air is admitted into the suction head 28 again. As it runs through the active section 54 of the movement path 46 between the receiving location 50 and the discharge location 52, the suction head 28 is thus continuously connected to the negative-pressure source 38. Furthermore, the active section 54 is curved concavely in a circular arc-like manner with respect to the movement path 46. In the active section 54, the suction head 28 is always located, at least approximately, at right angles with respect to the section 54.

As seen in the direction of circulation U, the movement path 46 runs from the discharge location 52 (in continuation of the active section 54) to a first turning point 56 located in the interior 12' of the rotor 12. From the first turning point, the movement path 46 runs to a second turning point 56' that is likewise located in the interior 12' and from which the movement path 46 runs to the receiving location 50. The movement path 46 is thus similar to a hypocycloid or an acute triangle, the shortest side of which contains the active section 54.

A movement path 46 of this type is achieved by the carrying arm 36 being mounted in a freely rotatable manner on a gear wheel 58 and in an eccentric manner with respect to the axis of rotation thereof. The gear wheel 58 is driven in rotation such that it meshes with an inner toothed rim 60. The circulatory path 62 of the carrying arm 36 thus corresponds to a hypocycloid with three points. A pivot lever 64 is seated in a rotationally fixed manner on the carrying arm 36 and is also articulated on a link plate 66. The link plate 66 is fastened in a pivotable manner on the housing 34' of the drive 34. By this connection to the housing 34', the carrying arm 36 is pivoted, when it runs through the circulatory path 62, such that the suction head 28 follows the movement path 46 described above.

Furthermore, a shaft 70 may be mounted on the bearing plates 32, 32'. A gear wheel 72 is seated in a rotationally fixed manner on the shaft 70, and a weighting lever 74 is mounted in a pivotable manner on the shaft 70. An endless pressure-exerting belt 76, which is designed as a toothed belt, is guided around the gear wheel 72 and a further gear wheel 72' that can rotate freely at the free end of the weighting lever 4. The bottom active strand 76' of the pressure-exerting belt 76 engages around the top of the rotor 20 in the region of the rotor arms 16 by an angle of approximately 90°. The shaft 70 is connected to the drive shaft 44 by a gear-wheel pair 78, with the interposition of a sliding or slip clutch or a friction bearing. The shaft 70 is driven in a direction A counter to the direction of rotation D. The circulating speed of the pressure-exerting belt 76 is predetermined by the speed of rotation of the rotor 12. The drive of the gear wheel 72 ensures that the section of the active strand 76' between the rotor 12 and the gear wheel 72 is always under specific tensile stressing.

Figure 3:
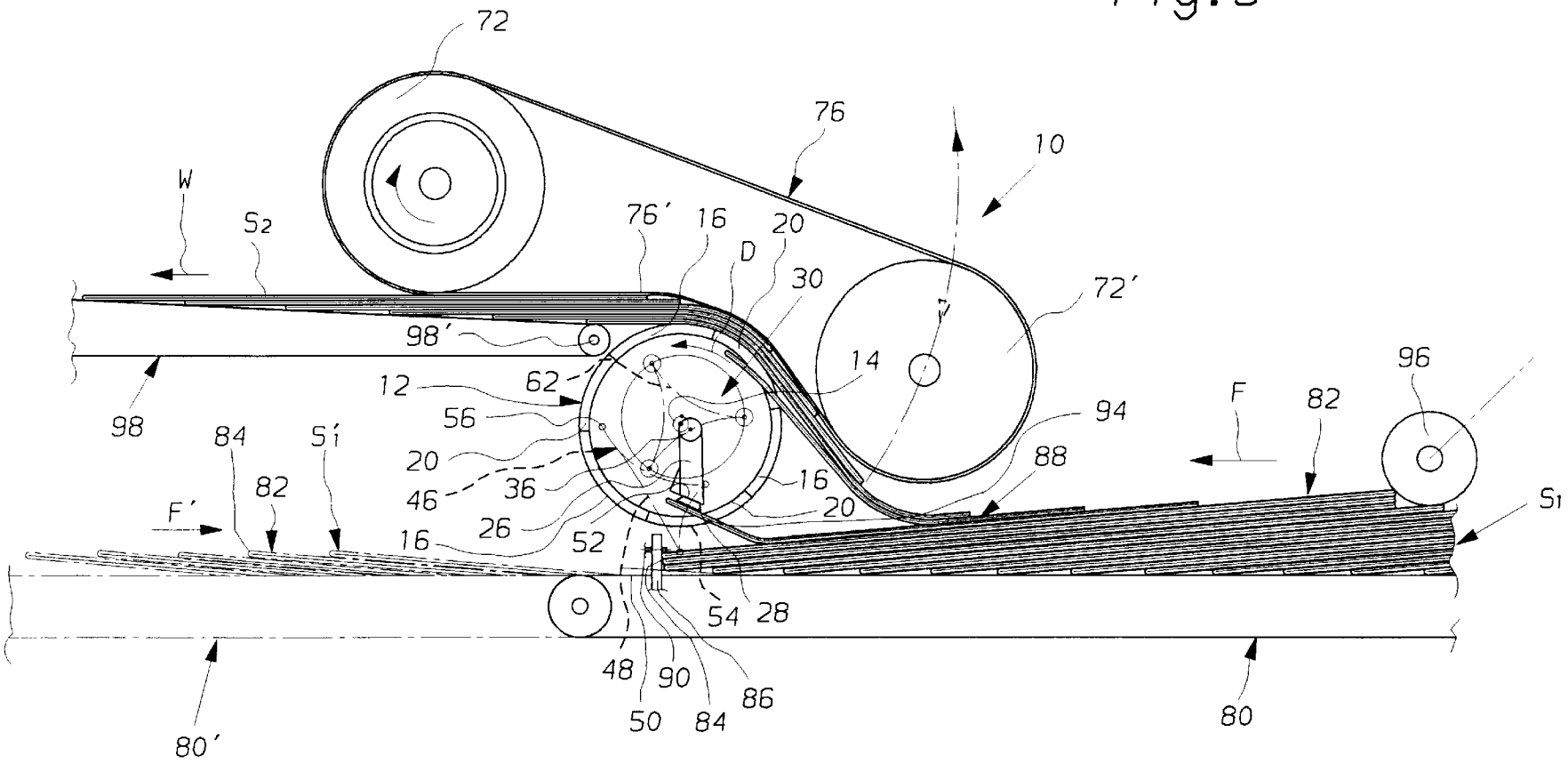
FIG. 3 shows, in elevation, a first embodiment of an apparatus for processing printed products of the present invention, the apparatus having the arrangement of FIGS. 1–2 and a pressure-exerting belt.

FIG. 3 shows an apparatus of the present invention for processing printed products 82. The apparatus has the arrangement 10 shown in FIGS. 1–2 and a pressure-exerting belt 76. The reference numerals used in FIG. 3 correspond to those used above.

The apparatus has a feed conveyor 80 that is designed as a belt conveyor and is intended for conveying the leading edge 84 of particular folded printed products 82 in an imbricated formation $S_1$ against a stop 86. In the imbricated formation $S_1$, each printed product 82 rests on the following printed product, with respect to the conveying direction F. In this embodiment, the leading edge 84 is the folded edge of the folded printed products 82. The printed products 82, butting one after the other against the stop 86, are pushed up to form an intermediate stack 88 that is fed from the bottom. At its upper end, the stop 86 may have a retaining lug 90 against which the printed products 82 come to rest from the bottom. As a result, it is possible to form an intermediate stack 88 with a precisely defined upper side.

The arrangement 10 is precisely arranged above the stop 86 so that the axis of rotation 14 runs at right angles with respect to the conveying direction F, and the receiving location 50 is located, with respect to the uppermost printed product 82 of the intermediate stack 88, in a corner region 94. The corner region 94 is adjacent to the edge 84 and a side edge 92 adjoining the edge 84, as can be seen in FIG. 2 with reference to the printed product 82 indicated by chain-dotted lines. For the sake of completeness, it should be mentioned that the arrangement 10 is located laterally outside the conveying region of the feed conveyor 80 and only projects from the side, via the rotor arms 16 and the carrying arm 36, beyond the conveying region.

A weighting roller 96 interacts with the feed conveyor 80 in order to ensure that the fed printed products 82 are made to butt against the stop 86.

Furthermore, the apparatus has a removal conveyer 98 that is similarly designed as a belt conveyor. The start 98' of the removal conveyor 98 is located adjacent to the rotor 12 and beneath the pressure-exerting belt 76. This location of the start 98' ensures a reliable transfer of the printed products 82 to the removal conveyor 98 from the conveying nip between the rotor 12 and the pressure-exerting belt 76.

A further embodiment of this apparatus is indicated by chain-dotted lines in FIG. 3. In this embodiment, the feed conveyor 80', which is also designed as a belt conveyor, is driven counter to the conveying direction F, in the conveying direction F'. The stop is located approximately at the position of the weighting roller 96, which is, however, not present in this embodiment. Each of the printed products 82, that are then fed in an imbricated formation $S_1$, rests on the following printed product 82, with respect to the conveying direction F', and has its folded edge 84 trailing. Here too, the printed products 82 are conveyed against the stop and pushed up to form an intermediate stack. The corner region 94 of the uppermost printed product 82 of the intermediate stack 88 then comes to lie at the same location as in the embodiment shown by solid lines.

As described in detail below, the printed products 82 are peeled away from the intermediate stack 88, one after the other, and are delivered to the range of action of the removal conveyor 98. The printed products 82 are then arranged in a new imbricated formation $S_2$ in which each printed product 82 once again rests on the following printed product, with respect to the conveying direction W of the removal conveyor 98.

Figure 4:
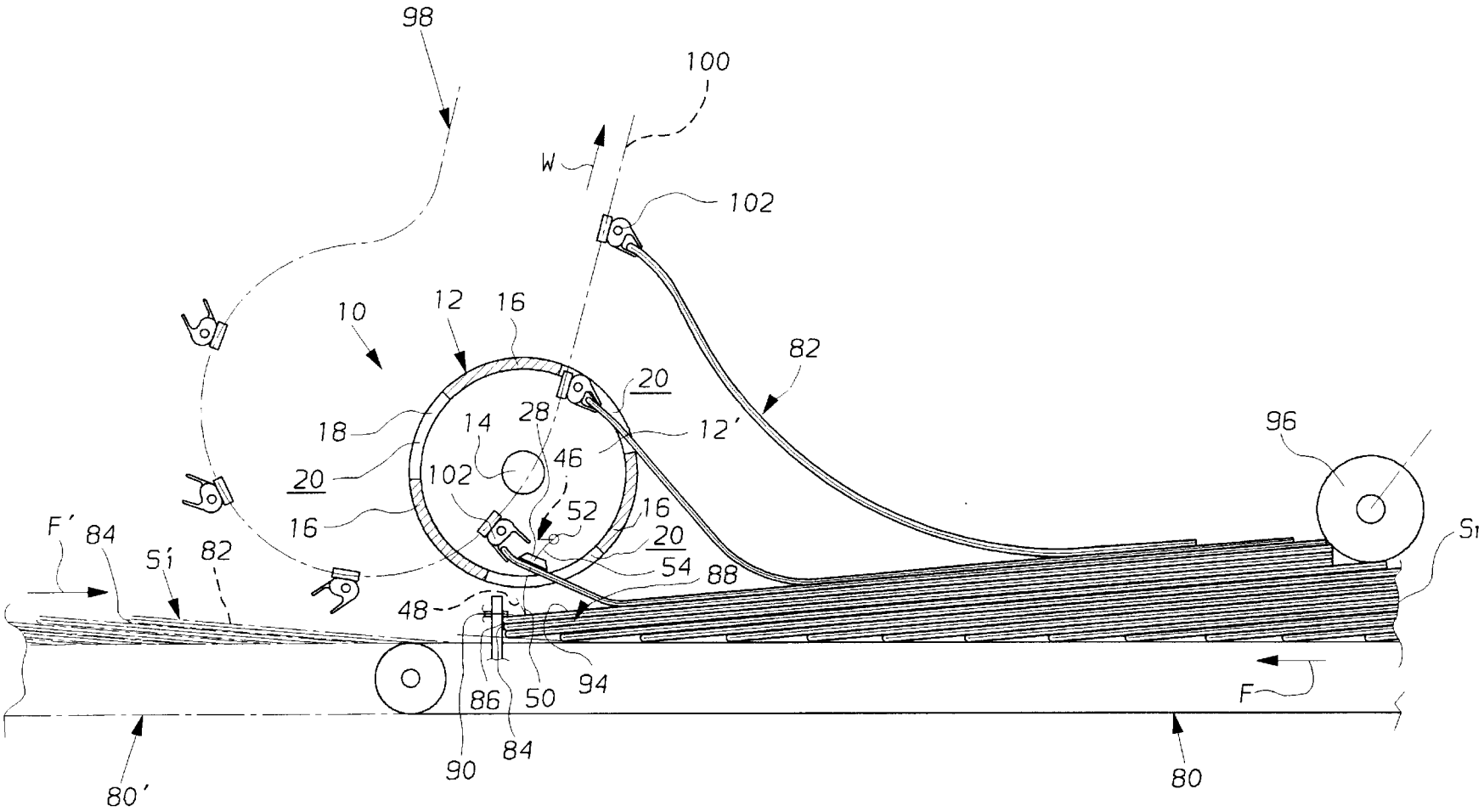
FIG. 4 shows, in elevation, an alternative embodiment of the apparatus for processing printed products of the present invention, the apparatus having the arrangement of FIGS. 1–2 without a pressure-exerting belt.

FIG. 4 shows an alternative embodiment of the apparatus, in which the feed conveyor 80 and the stop 86 are designed in the same manner as for the embodiment shown in FIG. 3. The arrangement 10 of this embodiment is once again located above the stop 86 (as shown in FIGS. 1–2), but does not have a pressure-exerting belt 76. The removal conveyor 98 is designed as a clamp-type transporter with individually controllable transporting clamps 102 that are arranged at a distance, one behind the other, on a drawing member 100. The drawing member 100 is driven in circulation in the removal direction W. The transporting clamps grip the edge 84 of each printed product 82 that is lifted from the intermediate stack 88 by the arrangement 10, and remove the printed product in the upward direction.

The operation of arrangement 10 will now be described with reference to FIGS. 1–4. At the receiving location 50, the suction head 28 is applied over the surface of the upper side of the uppermost printed product 82 of the intermediate stack 88, and grips the printed product in the corner region 94. When it runs through the active section 54, the suction head lifts the gripped printed product 82 upward, making it bend in certain areas in the process. The printed product then passes through the relevant cutout 20 and into the interior 12' of the rotor 12. Upon reaching the discharge location 52, the printed product 82 is released by air being admitted to the suction head 28. As a result of the rotation of the rotor 12, the rotor arm 16 directly following in the relevant cutout 20 has, in the meantime, gripped beneath the printed product 82 in the corner region 94. The rotor arm 16 supports the printed product 82 on its side located opposite the previous region of action of the suction head 28. As rotation continues, the rotor arm 16 moves the printed product 82 upward into the conveying nip formed by the rotor 12 and the pressure-exerting belt 76. The printed product 82 then comes from beneath to rest against the preceding printed product 82, with respect to the removal direction W. Consequently, the printed product 82 is forced out of the interior 12' of the rotor 12.

After having reached the discharge location 52, the suction head 28 is moved out of the range of movement of the printed product 82 supported by the rotor arm 16. The suction head 28 is then moved through the cutout 20 following the rotor arm 16 and into the receiving location 50 again for the purpose of gripping the next printed product 82.

Accordingly, in the embodiments shown in FIG. 3, it is in time with the arrangement 10 and the removal conveyor 98 that the printed products 82 are lifted from the intermediate stack 88 and moved into the new imbricated formation $S_2$, in which the printed products 82 assume a precisely defined position. It is not necessary for the printed products to arrive with this timing or in a high-quality imbricated formation $S_1$, (i.e. without any gaps or with mutually corresponding edges being spaced apart by a distance that lies within narrow limits).

In the embodiment shown in FIG. 4, the uppermost printed product 82 of the intermediate stack 88 is lifted by the sucker arrangement 30 and the rotor 12, in the same manner as shown in FIG. 3 and described above. In this embodiment, the printed product 82 is introduced, with its edge 84 in front, into the open mouth of a transporting clamp 102. The transporting clamp 102 then grips the printed product 82 by closing, and removes the printed product upward, peeling it away from the intermediate stack 88 in the process. The successive action of the sucker arrangement 30 and of the rotor 12 on the printed products 82 provides sufficient time for the printed products to be received by the transporting clamps 102, even in the case of a very high processing speed.

If no printed products 82 are to be fed to the removal conveyor 98 during a specific number of operating cycles, the connection to the negative-pressure source 38 is interrupted during these cycles, while the rotor and the sucker arrangement continue to be driven.

For the sake of completeness, it should be mentioned that the drive may be designed differently from the drive shown in FIGS. 1–2, and that the movement path 46 of the suction head 28 may also be in other forms, in particular a pear. For these modifications one is expressly referred to EP-A-0 628 505, to U.S. Pat. No. 5,377,961 and the corresponding EP-A-0 553 455, and to U.S. Pat. No. 4,127,262 and the corresponding CH Patent Specification No. 598 106.

Of course, the arrangement 10 is also suitable for removing printed products from a stack shaft or for gripping printed products that are being conveyed against a stop individually (or in an imbricated formation without intermediate-stack formation), and for moving the printed products into the range of action of a removal conveyor.

The embodiment of rotor 12 that is shown in FIGS. 1–4 has rotor arms 16 with a large extension in the circumferential direction for the purpose of supporting the printed products 82 over as large a surface area as possible in the conveying nip formed by the rotor 12 and the pressure-exerting belt 76. The rotor arms 16, however, may have a smaller extension in the circumferential direction (in particular, in an apparatus such as the one shown in FIG. 4).

As a result of the drum-like design of the rotor, the printed products are given careful treatment, in that they are acted upon in an extended region. Since the movement path of the suction head runs in the interior of the rotor and only one section extends outside the rotor, the arrangement has an extremely compact structure and reliable introduction of the printed products through the cutouts is ensured. Arranging the carrying element of the rotor and the drive of the sucker arrangement on one side (in relation to the suction head), on the one hand makes the compact design possible and, on the other hand, reduces the space requirement on the opposite side of the suction head. Access to the rotor and, in particular, to the cutouts thereof is free. As a result, it is possible to process printed products of different sizes, thus permitting versatile use of the arrangement. Successive action of the sucker arrangement and the rotor on the printed products allows the movement path of the suction head to be short, particularly in the operating section from the receiving location to the discharge location. This arrangement permits short cycle times and thus a high processing capacity.

The present invention has been illustrated and described with respect to the preferred embodiments of the invention. It is understood that the invention is not limited thereto, but may be otherwise variously embodied and practiced within the scope of the following claims including all equivalents.

I claim:

1. An arrangement for delivering printed products into a range of action of a removal conveyor comprising:

a carrying element driven in a direction of rotation;

a rotor having rotor arms, an interior, and an axis of rotation, the rotor arms being arranged in a drum-like manner around the axis of rotation of the rotor, the rotor arms also extending in the direction of the axis of rotation of the rotor and projecting outwardly from a side of the carrying element, the rotor arms being separated from one another by cutouts having an open side opposite the carrying element;

a sucker arrangement having a drive that is synchronized with the rotor, the drive being located on a side of the carrying element opposite the rotor, the sucker arrangement also having a carrying arm that is at least approximately parallel to the axis of rotation of the rotor, the carrying arm having an end connected to the drive, the carrying arm also having an extension arm connected to an end of the carrying arm opposite the drive, the extension arm running transversely with respect to the axis of rotation, the extension arm having a suction head attached to an end of the extension arm opposite the carrying arm, the suction head being periodically connected to a negative-pressure source and driven in circulation along a closed movement path by the drive, the movement path running in the interior of the rotor, the movement path having an approximately V-shaped section projecting in a radial direction through the cutouts and outside of the rotor, the approximately V-shaped section having a tip;

wherein the suction head grips a region adjoining a corner of a printed product at a receiving location provided at the tip of the approximately V-shaped section of the movement path, the suction head holding the printed product until the suction head reaches a discharge location located in the interior of the rotor, the printed product passing through the cutout into the interior of the rotor at the discharge location; and wherein a rotor arm directly following the cutout, in the direction of rotation, butts against the printed product on a side located opposite the suction head, and the rotor supports the printed product released by the suction head and forces the printed product into a range of action of a removal conveyor.

2. The arrangement of claim 1 wherein the carrying element is designed in a ring-like manner and the carrying arm runs through the carrying element.

3. The arrangement of claim 1 wherein the carrying arm is designed in a tubular manner and is flow-connected to the suction head.

4. The arrangement of claim 1 wherein the rotor arms are designed in a hollow, circular, cylindrical-like manner, the rotor arms having incisions running in a circumferential direction to widen the cutouts for the extension arm.

5. The arrangement of claim 1 further comprising a pressure-exerting belt that engages around the rotor, the pressure-exerting belt forming with the rotor arms a conveying nip for the printed products.

6. The arrangement of claim 1 wherein the movement path is in the form of a pear.

7. The arrangement of claim 1 wherein the movement path is in a form similar to a hypocycloid.

8. The arrangement of claim 1 further comprising:

a feed conveyor for conveying printed products against a stop, the feed conveyor having a conveying region;

a removal conveyor arranged above the feed conveyor, the removal conveyor having a range of action that starts adjacent to the rotor; and wherein the carrying element is arranged laterally outside the conveying region of the feed conveyor and the rotor arms are arranged above the conveying region of the feed conveyor.

9. The arrangement of claim 8 wherein the feed conveyor is designed as a belt conveyor, and the removal conveyor is designed as a belt conveyor.

10. The arrangement of claim 8 wherein the feed conveyor is designed as a belt conveyor, and the removal conveyor is designed as a clamp-type conveyor.

11. The arrangement of claim 8 wherein the feed conveyor feeds printed products in a feed direction against a stop, the printed products being arranged in an imbricated formation with each printed product resting on the following printed product, with respect to the feed direction, the feed conveyor also pushing the printed products into an intermediate stack at the bottom, and the sucker arrangement grips a respectively uppermost printed product of the intermediate stack, the sucker arrangement also peeling the uppermost printed product away from the intermediate stack in an upward direction.

12. An apparatus for processing printed products comprising:

a feed conveyor for conveying printed products in a feed direction against a stop, the feed conveyor having a conveying region;

a removal conveyor arranged above the feed conveyor, the removal conveyor having a range of action; and an arrangement for delivering printed products into the range of action of the removal conveyor, the arrangement including:

a carrying element driven in a direction of rotation and arranged laterally outside the conveying region of the feed conveyor;

a rotor arranged above the conveying region of the feed conveyor, the rotor having an interior and rotor arms, the rotor arms being arranged in a drum-like manner around an axis of rotation and projecting outwardly from a side of the carrying element, the rotor arms being separated from one another by cutouts;

a sucker arrangement having a carrying arm driven by a drive, the carrying arm having an end connected to the drive and an extension arm connected to an end of the carrying arm opposite the drive, the extension arm having a suction head attached to an end of the extension arm opposite the carrying arm, the suction head having a movement path running in the interior of the rotor, the movement path having an approximately V-shaped section projecting in a radial direction through the cutouts and outside of the rotor; and wherein the extension arm runs through a cutout of the rotor to grip a corner region of a printed product and move the printed product into the interior of the rotor, and the rotor arm engages beneath the printed product and lifts the printed product further to deliver the printed product into a range of action of a removal conveyor.

13. The apparatus of claim 12 wherein the feed conveyor is designed as a belt conveyor, and the removal conveyor is designed as a belt conveyor.

14. The apparatus of claim 12 wherein the feed conveyor is designed as a belt conveyor, and the removal conveyor is designed as a clamp-type conveyor.

15. The apparatus of claim 12 wherein the feed conveyor feeds printed products in a feed direction against a stop, the printed products being arranged in an imbricated formation with each printed product resting on the following printed product, with respect to the feed direction, the feed conveyor also pushing the printed products into an intermediate stack at the bottom, and the arrangement further includes a sucker arrangement for gripping a respectively uppermost printed product of the intermediate stack, the sucker arrangement also peeling the uppermost printed product away from the intermediate stack in an upward direction.

16. An arrangement for delivering printed products into a range of action of a removal conveyor comprising:

a carrying element driven in a direction of rotation;

a rotor having an interior and rotor arms, the rotor arms being separated from one another by cutouts;

a sucker arrangement having a carrying arm, the carrying arm having an extension arm connected to an end of the carrying arm, the extension arm having a suction head attached to an end of the extension arm opposite the carrying arm, the a drive mechanism to move suction head along a movement path running in the interior of the rotor, the movement path having an approximately V-shaped section projecting in a radial direction through the cutouts and outside of the rotor; and wherein the drive mechanism runs the extension arm out through a cutout of the rotor to grip a corner region of a printed product and move the printed product into the interior of the rotor, and the rotor arm engages beneath the printed product and lifts the printed product further to deliver the printed product into a range of action of the removal conveyor.

17. The arrangement of claim 16 wherein the carrying element is designed in a ring-like manner and the carrying arm runs through the carrying element.

18. The arrangement of claim 16 wherein the carrying arm is designed in a tubular manner and is flow-connected to the suction head.

19. The arrangement of claim 16 wherein the rotor arms are designed in a hollow, circular, cylindrical-like manner, the rotor arms having incisions running in a circumferential direction to widen the cutouts for the extension arm.

20. The arrangement of claim 16 further comprising a pressure-exerting belt that engages around the rotor, the pressure-exerting belt forming with the rotor arms a conveying nip for the printed products.

* * * * *